United States Patent [19]

Ishikawa et al.

[11] Patent Number: 4,916,417

[45] Date of Patent: Apr. 10, 1990

[54] MICROSTRIPLINE FILTER

[75] Inventors: Youhei Ishikawa; Jun Hattori; Hideyuki Kato, all of Nagaokakyo, Japan

[73] Assignee: Murata Mfg. Co., Ltd., Japan

[21] Appl. No.: 397,642

[22] Filed: Aug. 22, 1989

Related U.S. Application Data

[63] Continuation of Ser. No. 171,218, Mar. 21, 1988, abandoned, which is a continuation of Ser. No. 909,519, Sep. 19, 1986, abandoned.

[30] Foreign Application Priority Data

Sep. 24, 1985 [JP] Japan ..... 60-210599
May 9, 1986 [JP] Japan ..... 61-107199

[51] Int. Cl.[4] ..... H01P 1/203

[52] U.S. Cl. ..... 333/204; 333/205; 333/238

[58] Field of Search ..... 333/161, 204, 205, 238, 333/246

[56] References Cited

U.S. PATENT DOCUMENTS 2,810,892 10/1987 Blitz ..... 333/238
2,913,686 11/1959 Fubini et al. ..... 333/238
2,964,718 12/1960 Packard ..... 333/205 X
2,994,050 7/1961 Ayer et al. ..... 333/238
4,157,517 6/1979 Kneisel et al. .

OTHER PUBLICATIONS

*Reference Data For Radio Engineers,* Fifth Edition, by ITT, H. W. Sams & Co., N.Y., 1968, Title page and pp. 4–28 & 4–30.

*Handbook Of Tri-Plate Microwave Components,* Sanders Assoc., Nashua, N.H., 1956, pp. 3, 4 & title page.

*Primary Examiner*—Paul Gensler
*Attorney, Agent, or Firm*—Ostrolenk, Faber, Gerb & Soffen

[57] ABSTRACT

A filter employing Triplate type microstripline as the base element comprises first and second dielectric substrates which are superposed with each other so as to hold a resin sheet therebetween, and are contained in a metal case. The respective dielectric substrates are provided on outer major surfaces with ground electrodes to be electrically connected with the metal case. Resonance electrodes are provided on inner major surfaces of the respective dielectric substrates to be electrically connected with relating ground electrodes through end surfaces of the dielectric substrates. The resin sheet holds metal pins passing through the same along the direction of thickness thereof, so that the respective resonance electrodes of the first and second dielectric substrates are electrically connected with each other by the metal pins.

31 Claims, 2 Drawing Sheets

MICROSTRIPLINE FILTER

This is a continuation of Application Ser. No. 07/171,218 filed on Mar. 21, 1988, which is a continuation of Application Ser. No. 06/909,519 filed on Sept. 19, 1986, both of which are now abandoned.

BACKGROUND OF THE INVENTION

1. Field of the Invention

The present invention relates to the so-called Triplate type microstripline applicable to a transmission line for microwaves, a filter, a microwave integrated circuit (MIC) employing such elements and the like.

2. Description of the Prior Art

FIGS. 7 and 8 illustrate conventional microstriplines generally employed as transmission lines for MICs.

The microstripline as shown in FIG. 7 comprises a dielectric substrate 101 of ceramic for example, which is provided with a ground electrode 102 on one major surface and a line electrode 103 on the other major surface. Although such a microstripline is simple in structure, the same exhibits large conductor loss and electromagnetic field leakage.

On the other hand, the microstripline member as shown in FIG. 8 is of the so-called Triplate type, which comprises two dielectric substrates 106 and 107 of ceramic for example, provided on major surfaces thereof with ground electrodes 104 and 105, and provided with a line electrode 108 interposed between the same. This microstripline is smaller in conductor loss than that of FIG. 7, and has substantially no electromagnetic field leakage.

In the microstripline member as shown in FIG. 8, however, a small gap 109 shown by the dotted line may occur defined between the line electrode 108 and the dielectric substrate 106 or 107 due to warpage of the dielectric substrate 106 or 107 or displacement thereof with respect to the other one upon superposition, to degrade the circuit constants (characteristic impedance, effective dielectric constant etc.) of the microstripline, leading to unstable characteristics of a filter or a circuit employing the microstripline member.

SUMMARY OF THE INVENTION

Accordingly, it is an object of the present invention to provide a microstripline which can improve circuit constant accuracy while suppressing conductor loss and electromagnetic field leakage similarly to the conventional microstripline.

The microstripline according to the present invention comprises two dielectric substrates each provided with a ground electrode and a line electrode on opposite major surfaces, which dielectric substrates are so superposed that the line electrodes face each other and hold therebetween an insulating sheet which is lower in dielectric constant than the dielectric substrates. The opposite line electrodes are made to electrically communicate with each other by a conducting member passing through the insulating sheet.

Even if a gap occurs or is defined between either line electrode and the insulating sheet of the microstripline according to the present invention, the relative influence of such a gap is reduced by the interposed insulating sheet. Thus, circuit constant accuracy is remarkably improved. The two line electrodes are made to electrically communicate with each other so that in-phase current flows between the same, whereby conductor loss is reduced with substantially no electromagnetic field leakage.

According to another aspect of the present invention, provided is a microstripline filter which can obtain stable filter characteristics, with the aforementioned microstripline being employed as the base element.

The present invention is also directed to provide a structure for the aforementioned microstripline filter which can be manufactured with higher productivity.

The microstripline filter according to the present invention comprises first and second dielectric substrates each having two major surfaces and an end surface connecting the two major surfaces with each other. First and second ground electrodes are formed on one-side major surfaces of the first and second dielectric substrates, respectively, while first and second resonance electrodes are formed on the other major surfaces of the first and second dielectric substrates, respectively. The first and second dielectric substrates are superposed with each other so as to hold an insulating sheet lower in dielectric constant than the dielectric substrates between the first and second resonance electrodes, which are electrically connected with each other by at least one conducting member such as a metal pin passing through the insulating sheet.

According to the aforementioned structure, the resonance electrodes are formed on the respective said other major surfaces of the first and second dielectric substrates, whereby no gap is defined between such resonance electrodes and the dielectric substrates. Further, the insulating sheet is interposed between the first and second resonance electrodes, and even if a gap is defined or occurs between the insulating sheet and either resonance electrode, the influence of the same is remarkably small in comparison with that of gaps between the resonance electrodes and between the dielectric substrates. Thus, the microstripline filter in such structure is further stabilized in electric characteristics.

The first resonance electrode on the first dielectric substrate side is made to electrically communicate with the second resonance electrode on the second dielectric substrate side through the conducting member. Therefore, in-phase current flows between the same, whereby conductor loss is reduced and substantially no electromagnetic field leakage takes place. Thus, the microstripline filter according to the present invention is equivalent to the conventional one in conductor loss and electromagnetic field leakage.

In a preferred embodiment of the present invention, metal pins are employed to electrically connect the opposite pair of resonance electrodes with each other, which metal pins are held in place by passing through the insulating sheet. Therefore, the metal pins can be assembled in prescribed positions without requiring any specific holding means. The first and second dielectric substrates are pressed against each other so that respective end portions of the metal pins are electrically connected with the first and second resonance electrodes in a stabilized manner. Thus, operations included in the manufacturing steps are simplified to improve productivity. As the result, the microstripline filter can be provided at a low cost.

It has been confirmed that filter characteristics such as resonance frequency and coupling coefficient are varied with the size, position and number of the metal pins. Thus, the filter characteristics can be easily adjusted by changing the factors related to the metal pins. In the conventional microstripline filter, filter characteristics have depended on the material for the dielectric substrates, the size and configuration of the resonance electrodes and the like. In order to obtain desired filter characteristics, therefore, it has been necessary to adjust the said factors by repeatedly changing the design, whereby much time has been required for product development. Even if the aforementioned factors have been determined in correspondence to the desired filter characteristics, extremely strict accuracy has been required to prevent variation in filter characteristics, leading to difficulty in production. According to the preferred embodiment of the present invention, it is possible to easily obtain desired filter characteristics, which are adjustable by the metal pins.

DESCRIPTION OF THE PREFERRED EMBODIMENTS

Figure 1:
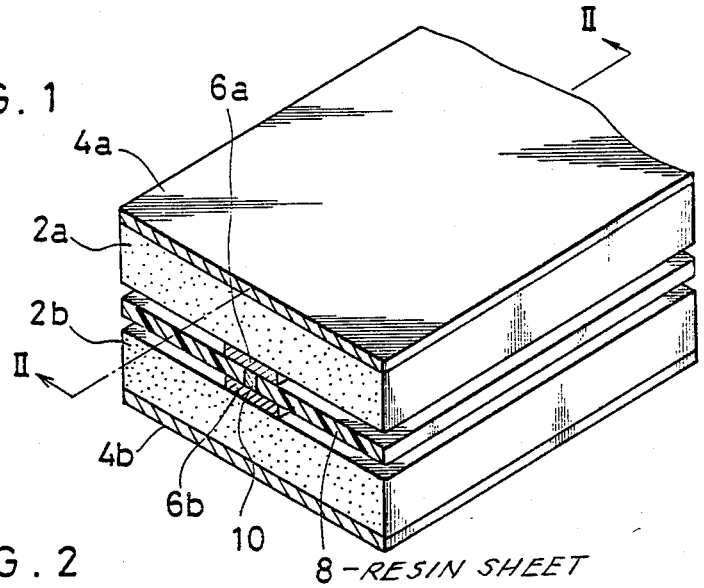
FIG. 1 is a perspective view partially illustrating a microstripline member according to an embodiment of the present invention.
Figure 2:
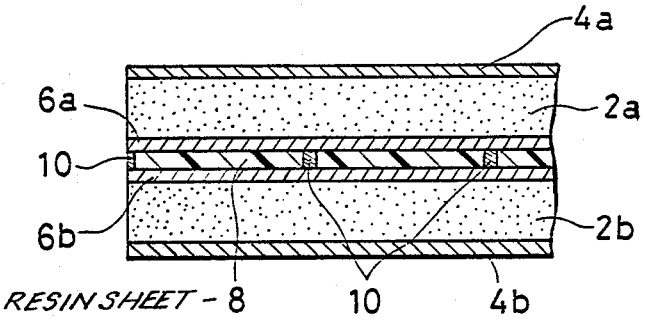
FIG. 2 is a sectional view taken along the line II—II in FIG. 1.
Figure 7:
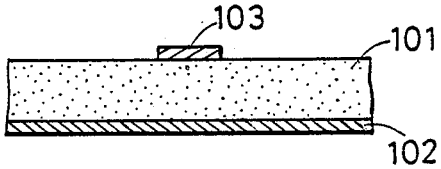
FIG. 7 PRIOR ART
FIGS. 7 and 8 are sectional views partially illustrating conventional microstriplines.

FIGS. 1 and 2 illustrate a microstripline member according to an embodiment of the present invention, which comprises two dielectric substrates 2*a* and 2*b* provided with ground electrodes 4*a* and 4*b* and line electrodes 6*a* and 6*b* on respective major surfaces. In other words, two microstriplines having such structure as shown in FIG. 7 are superposed so that the line electrodes 6*a* and 6*b* are opposite to each other. Thus superposed, the line electrodes 6*a* and 6*b* hold a thin resin sheet 8 lower in dielectric constant than the dielectric substrates 2*a* and 2*b* therebetween, to provide the so-called Triplate type microstripline member. The opposite line electrodes 6*a* and 6*b* electrically communicate with each other at several prints through conducting members 10 passing through the resin sheet 8.

The dielectric substrates 2*a* and 2*b* are made of alumina ceramic for example, and the line electrodes 6*a* and 6*b* are previously formed by baking or the like. The resin sheet 8 is preferably prepared from a resilient material such as Teflon (trade name) and is formed with through-holes in several places in a portion of the sheet that is interposed between the line electrodes 6*a* and 6*b*. Conductive paste such as silver paste, or possibly the same material as the line electrodes 6*a* and 6*b*, or another solder paste, is previously injected into such through-holes. It is then pressed by the line electrodes 6*a* and 6*b* or further heated if necessary, thereby to electrically connect the line electrodes 6*a* and 6*b* with each other. Alternatively the through-holes provided in the resin sheet 8 may be plated with thin conducting members 10, thereby to electrically connect the line electrodes 6*a* and 6*b* with each other. As a further alternative, metal pins may be inserted in the through-holes to serves as the conducting members 10.

In such a microstripline member, substantially no gap is defined between the line electrodes 6*a* and 6*b* and the resin sheet 8 due to excellent adhesion of the resin sheet 8. Even if any gap is defined, the relative influence thereof is reduced by the higher relative dielectric constant of the resin sheet 8 in comparison with that of any air gap and insertion of the resin sheet 8. In case of a gap of 1 $\mu$m, for example, the influence thereof is remarkably reduced with respect to the resin sheet 8 of, e.g., 100 $\mu$m in thickness, compared with a conventional microstripline member provided with no such resin sheet, whereby circuit constant accuracy is extremely improved. In other words, relative variation in circuit constant is suppressed.

Figure 8:
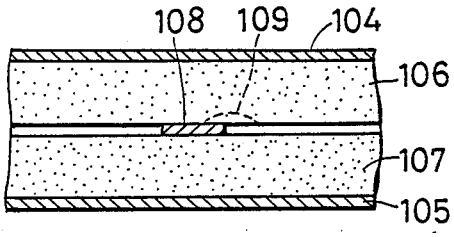
FIG. 8 PRIOR ART

The two line electrodes 6*a* and 6*b* electrically communicate with each other through the conducting members 10 so that in-phase current flows between the same, whereby substantially no electromagnetic field leakage takes place similarly to the microstripline member as shown in FIG. 8, and the conductor loss is also as small as that of the microstripline member as shown in FIG. 8.

Thus, a stable circuit such as an MIC of high performance can be obtained with the aforementioned microstripline member.

Figure 3:
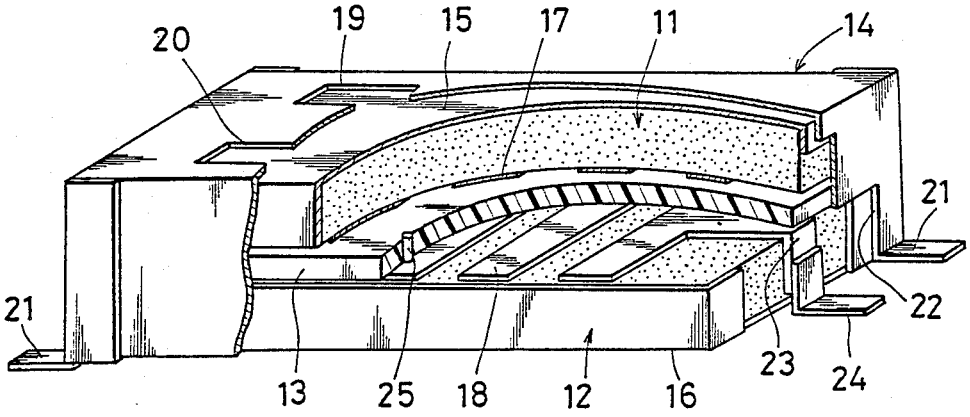
FIG. 3 is a partially fragmented perspective view showing a microstripline filter according to another embodiment of the present invention.
Figure 4:
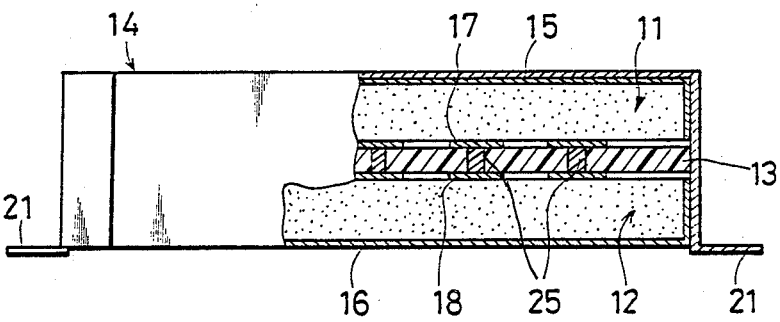
FIG. 4 is a partially fragmented front elevational view of the microstripline filter as shown in FIG. 3.

FIGS. 3 and 4 illustrate a microstripline filter according to another embodiment of the present invention.

This microstripline filter mainly comprises first and second dielectric substrates 11 and 12 of ceramic for example, and an insulating sheet 13 of resin for example interposed therebetween, and a metal case 14 containing the dielectric substrates 11 and 12.

The first dielectric substrate 11 is provided with a ground electrode 15 on its upper major surface and the second dielectric substrate 12 is provided with another ground electrode 16 on its lower major surface. A resonance electrode 17 is formed on the lower major surface of the first dielectric substrate 11 in the form of a comb line. Another resonance electrode 18 is formed on the upper major surface of the second dielectric substrate 12 also in the form of a comb line. The resonance electrodes 17 and 18 are symmetrically arranged opposite to each other on opposite sides of the interposed insulating sheet 13. Further, the respective resonance electrodes 17 and 18 are connected with corresponding ground electrodes 15 and 16 at end surfaces of the dielectric substrates 11 and 12 (connection not shown).

The first and second dielectric substrates 11 and 12 are so contained in the metal case 14 that the major surfaces provided with the resonance electrodes 17 and 18 are opposite to each other so as to hold the insulating sheet 13 therebetween. The metal case 14 is preferably integrally formed by punching a metal sheet and bending the same, as shown in FIGS. 3 and 4. The inner surface of the metal case 14 is in contact with the ground electrode 15 and conducting layers formed on the end surfaces of both the dielectric substrates 11 and 12, whereby it is also electrically connected with the ground electrode 16. In any event, the metal case 14 should at least be electrically connected to conductive portions extending from the ground electrodes 15 and 16. The metal case 14 has a plurality of windows 19 and 20 to facilitate connection of the ground electrodes 15 and 16 and the metal case 14 through externally applied solder. The metal case 14 is integrally formed with outwardly extending ground terminal members 21, to facilitate soldering of the microstripline filter to an appropriate printed circuit board through face bonding. The metal case 14 is further provided with a recess 22, to expose an outgoing electrode 23 from the resonance electrode 18 of the second dielectric member 12, for example. The outgoing electrode 23 is connected with an input/output terminal member 24 for input or output through the recess 22. This input/output terminal member 24 is in a configuration suitable for face bonding. Another input/output terminal member (not shown) substantially identical to the input/output terminal member 24 is provided on the left side face of the metal case 14 as shown in FIG. 3, for being connected with the resonance electrode 17 in a similar mode.

Referring to FIGS. 3 and 4, metal pins 25 pass through the insulating sheet 13 to serve as conducting members for electrically connecting the resonance electrodes 17 and 18 with each other. Such electrical connection can be easily achieved by pressing the first and second dielectric substrates 11 and 12 against each other. The metal case 14 is also adapted to hold the first and second dielectric substrates 11 and 12 in such a pressed state.

Figure 5:
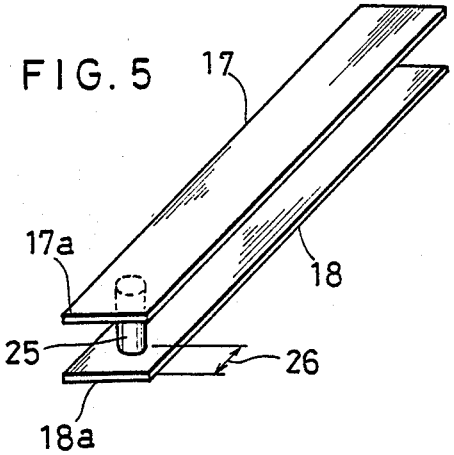
FIG. 5 is a perspective view partially illustrating an opposite pair of resonance electrodes 17 and 18 and a metal pin 25 as shown in FIG. 3.

FIG. 5 partially illustrates the opposite resonance electrodes 17 and 18 and one of the metal pins 25. Numerals 17*a* and 18*a* denote voltage open ends of the resonance electrodes 17 and 18 respectively. The metal pin 25 is preferably formed in close vicinity to the voltage open ends 17*a* and 18*a*, so that the resonance electrode portion including the metal pin 25 and the voltage open ends 17*a* and 18*a* does not serve as a so-called "stub". Filter characteristics can be adjusted by means of the metal pin 25 by changing the distance 26 as shown in FIG. 5. The distance 26 can be varied with the position of a through-hole formed in the insulating sheet 13 for receiving the metal pin 25. Alternatively a larger hole may be formed in the insulating sheet 13 so that the position of the metal pin 25 may be varied in the hole thereby to change the distance 26.

Thus, the position of the metal pin 25 can be arbitrarily selected.

Figure 6:
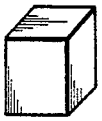
FIG. 6 is a perspective view showing a modification of the metal pin.

Although the aforementioned metal pin 25 is circular in section, the same may have an angular section as shown in FIG. 6. Further, the metal pin may be modified in various configurations, to adjust the filter characteristics.

The metal pins may be in the form of bars provided along the longitudinal direction of the resonance electrodes.

Further, the number of the metal pins may not be one for every branch of the resonance electrodes 17 and 18 in the form of comb lines as shown in FIG. 4. The metal pins are merely adapted to adjust the filter characteristics, and hence a plurality of metal pins may be provided in every branch while, alternatively, some of the branches may be provided with no such metal pin.

Although the comb line type resonance electrodes 17 and 18 are employed in the aforementioned embodiment, the present invention is also applicable to a filter provided with interdigital type resonance electrodes.

Although the insulating sheet 13 is made of resin in the aforementioned embodiment, the same may be formed of glass or ceramic material lower in dielectric constant than the dielectric substrates 11 and 12. This also applies to the embodiment as shown in FIGS. 1 and 2.

Although embodiments of the present invention have been described and illustrated in detail, it is clearly understood that the same is by way of illustration and example only and is not to be taken by way of limitation, the spirit and scope of the present invention being limited only by the terms of the appended claims.

What is claimed is:

1. Microstripline comprising:

a first dielectric substrate having outer and inner opposite major surfaces;

a second dielectric substrate having outer and inner opposite major surfaces;

a first ground electrode formed on said outer major surface of said first dielectric substrate;

a first line electrode formed on said inner major surface of said first dielectric substrate;

a second ground electrode formed on said outer major surface of said second dielectric substrate;

a second line electrode formed on said inner major surface of said second dielectric substrate;

an insulating sheet interposed between said first and second dielectric substrates which are so arranged that said first and second line electrodes are opposite to each other, said insulating sheet being lower in dielectric constant than said first and second dielectric substrates; and a conducting member passing through said insulating sheet along the direction of thickness thereof to electrically connect said first and second line electrodes with each other.

2. Microstripline in accordance with claim 1, wherein said insulating sheet is made of resin.

3. Microstripline in accordance with claim 2, wherein said resin has resiliency.

4. Microstripline in accordance with claim 1, wherein said insulating sheet is provided with a through-hole passing through the same along the direction of thickness thereof so that said conducting member is received in said through-hole.

5. Microstripline in accordance with claim 4, wherein said conducting member includes conductive paste filling said through-hole.

6. Microstripline in accordance with claim 4, wherein said conducting member includes a metal pin inserted in said through-hole.

7. Microstripline in accordance with claim 4, wherein said conducting member includes a metal-plated film formed on an inner peripheral surface of said through-hole.

8. A microstripline filter having a predetermined resonance frequency comprising:

a first dielectric substrate having inner and outer opposite major surfaces;

a second dielectric substrate having inner and outer opposite major surfaces;

a first ground electrode formed on said outer major surface of said first dielectric substrate;

a first resonance electrode which is resonant at said predetermined resonance frequency and is formed on said inner major surface of said first dielectric substrate;

a second ground electrode formed on said outer major surface of said second dielectric substrate;

a second resonance electrode which is resonant at said predetermined resonance frequency and is formed on said inner major surface of said second dielectric substrate;

an insulating sheet interposed between said first and second dielectric substrates which are so arranged that said first and second resonance electrodes are opposite to each other, said insulating sheet being lower in dielectric constant than said first and second dielectric substrates; and a conducting member passing through said insulating sheet along the direction of thickness thereof to electrically connect said first and second resonance electrodes with each other.

9. A microstripline filter in accordance with claim 8, wherein said conducting member comprises a metal pin.

10. A microstripline filter in accordance with claim 9, wherein said metal pin is circular in section.

11. A microstripline filter in accordance with claim 9, wherein said metal pin is angular in section.

12. A microstripline filter in accordance with claim 8, wherein said first and second resonance electrodes have voltage open ends and said conducting member is positioned in close proximity to said voltage open ends of said first and second resonance electrodes.

13. A microstripline filter in accordance with claim 8, further comprising a metal case for containing said first and second dielectric substrates holding said insulating sheet therebetween.

14. A microstripline filter in accordance with claim 13, wherein said metal case is provided with a window to be connected with at least one of said first and second ground electrodes by externally applied solder.

15. A microstripline filter in accordance with claim 13, wherein said metal case is integrally formed with outwardly extending ground terminal members.

16. A microstripline filter in accordance with claim 15, wherein said metal case is provided with recesses for extracting first and second input/output terminal members respectively connected with said first and second resonance electrodes through said recesses.

17. A microstripline filter in accordance with claim 8, wherein said insulating sheet is made of resin.

18. A microstripline filter in accordance with claim 8, wherein said insulating sheet is made of glass.

19. A microstripline filter in accordance with claim 8, wherein said insulating sheet is made of ceramic.

20. Microstripline comprising:

a first dielectric substrate having inner and outer opposite major surfaces;

a second dielectric substrate having inner and outer opposite major surfaces;

a first ground electrode formed on said outer major surface of said first dielectric substrate;

a first line electrode formed on said inner major surface of said first dielectric substrate;

a second ground electrode formed on said outer major surface of said second dielectric substrate;

a second line electrode formed on said inner major surface of said second dielectric substrate;

a resilient resin insulating sheet interposed between said first and second dielectric substrates which are so arranged that said first and second line electrodes are opposite to each other, said insulating sheet being lower in dielectric constant than said first and second dielectric substrates; and a conducting member passing through said insulating sheet along the direction of thickness thereof to electrically connect said first and second line electrodes with each other.

21. A microstripline filter having a predetermined resonance frequency comprising:

a first dielectric substrate having inner and outer opposite major surfaces;

a second dielectric substrate having inner and outer opposite major surfaces;

a first ground electrode formed on said outer major surface of said first dielectric substrate;

a first resonance electrode which is resonant at said predetermined resonance frequency and is formed on said inner major surface of said first dielectric substrate;

a second ground electrode formed on said outer major surface of said second dielectric substrate;

a second resonance electrode which is resonant at said predetermined resonance frequency and is formed on said inner major surface of said second dielectric substrate;

a resilient resin insulating sheet interposed between said first and second dielectric substrates which are so arranged that said first and second resonance electrodes are opposite to each other, said insulating sheet being lower in dielectric constant than said first and second dielectric substrates; and a conducting member passing through said insulating sheet along the direction of thickness thereof to electrically connect said first and second resonance electrodes with each other.

22. A microstripline filter having a predetermined resonance frequency comprising:

(a) a first dielectric substrate having inner and outer opposite major surfaces;

(b) a second dielectric substrate having inner and outer opposite major surfaces;

(c) a first ground electrode formed on said outer major surface of said first dielectric substrate;

(d) a second ground electrode formed on said outer surface of said second dielectric substrate;

(e) a plurality of resonators, each resonator comprising:

(1) a first resonance electrode which is resonant at said predetermined resonance frequency and is formed on said inner major surface of said first dielectric substrate;

(2) a second resonance electrode which is resonant at said predetermined resonance frequency and is formed on said inner major surface of said second dielectric substrate; said first and second dielectric substrates being so arranged that said first and second resonance electrodes are opposite to each other; and (f) coupling means for coupling said resonators by adjusting the coupling coefficient between said resonators, said coupling means comprising at least one conducting member which electrically connects said first and second resonance electrodes with each other.

23. A microstripline filter as in claim 22, wherein said coupling means further comprises an insulating sheet interposed between said first and second dielectric substrates and between said resonators, said conducting member passing through said insulating sheet along the direction of thickness thereof and said insulating sheet being lower in dielectric constant than said first and second dielectric substrates.

24. A microstripline filter as in claim 23, wherein said insulating sheet comprises a resilient insulating resin.

25. A microstripline filter as in claim 23, wherein said coupling coefficient can be adjusted as an inverse function of said dielectric constant of said insulating sheet.

26. A microstripline filter as in claim 23, wherein said coupling coefficient can be adjusted as a direct function of a thickness of said insulating sheet between said dielectric substrates.

27. A method of providing a microstripline filter having a predetermined resonance frequency comprising the steps of:

(1) providing a filter structure which comprises:

(a) a first dielectric substrate having inner and outer opposite major surfaces;

(b) a second dielectric substrate having inner and outer opposite major surfaces;

(c) a first ground electrode formed on said outer major surface of said first dielectric substrate;

(d) a second ground electrode formed on said outer surface of said second dielectric substrate; and (e) a plurality of resonators, each resonator comprising:

(i) a first resonance electrode which is resonant at said predetermined resonance frequency and is formed on said inner major surface of said first dielectric substrate;

(ii) a second resonance electrode which is resonant at said predetermined resonance frequency and is formed on said inner major surface of said second dielectric substrate; said first and second dielectric substrates being so arranged that said first and second resonance electrodes are opposite to each other; and (iii) at least one conducting member electrically connecting said first and second resonance electrodes with each other; and (2) coupling said resonators by adjusting the coupling coefficient between said resonators by adjusting physical characteristics of the at least one conducting member.

28. A method as in claim 27, wherein said coupling coefficient is further adjusted by interposing an insulating sheet between said first and second dielectric substrates and between said resonators, said conducting member passing through said insulating sheet along the direction of thickness thereof and said insulating sheet being lower in dielectric constant than said first and second dielectric substrates.

29. A method as in claim 28, wherein said insulating sheet comprises a resilient insulating resin.

30. A method as in claim 28, which includes steps of increasing said coupling coefficient by decreasing said dielectric constant of said insulating sheet, and vice versa.

31. A method as in claim 28, which includes steps of increasing said coupling coefficient by increasing a thickness of said insulating sheet between said dielectric substrates, and vice versa.

* * * * *